United States Patent [19]

Ceresko

[11] 4,137,613

[45] Feb. 6, 1979

[54] HEADLINERS FOR CASKETS

[76] Inventor: Joseph S. Ceresko, R.D. #3, Lake Ariel, Pa. 18436

[21] Appl. No.: 817,187

[22] Filed: Jul. 20, 1977

[51] Int. Cl.[2] ..... A61G 17/04

[52] U.S. Cl. ..... 27/19

[58] Field of Search ..... 27/19

[56] References Cited

U.S. PATENT DOCUMENTS

| | | | |
|---|---|---|---|
| 2,637,137 | 5/1953 | Flynn | 27/19 |
| 3,077,016 | 2/1963 | White | 27/19 |
| 3,157,936 | 11/1964 | Hillenbrand | 27/19 |
| 3,162,923 | 12/1964 | Kaeser | 27/19 |
| 3,228,085 | 1/1966 | Nelson | 27/19 |
| 3,487,513 | 1/1970 | Herring et al. | 27/19 |
| 3,735,457 | 5/1973 | Esterdahl | 27/19 |
| 3,831,230 | 8/1974 | Rawlings | 27/19 |

*Primary Examiner*—John D. Yasko

*Attorney, Agent, or Firm*—Kane, Dalsimer, Kane, Sullivan and Kurucz

[57] ABSTRACT

A self-supporting head liner is vacuum formed from a thermoplastic liner member molded from a single sheet of material. The liner member includes a central panel of generally rectangular configuration and a transversely extended four-sided apron. A recess of predetermined depth is located at each of the corners defined by the apron side and a layer of selected fabric is adhesively secured to the inner face of the panel and apron and conform to the contour thereof and for the distinct purpose of imitating the pattern of traditional sheered puffing. Excess portions of the fabric which inherently result from the vacuum forming operation are taken up and extend into the recesses for purposes of avoiding any unwanted wrinkles and pleats in the fabric.

8 Claims, 7 Drawing Figures

FIG. 5
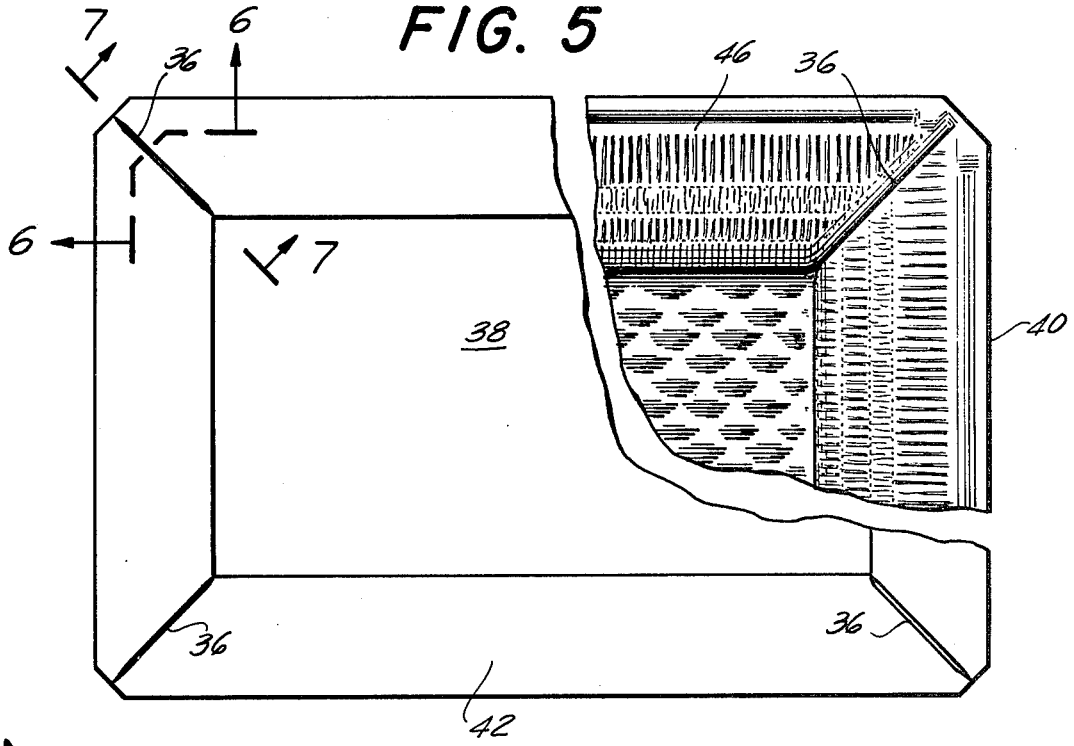
FIG. 6
FIG. 7
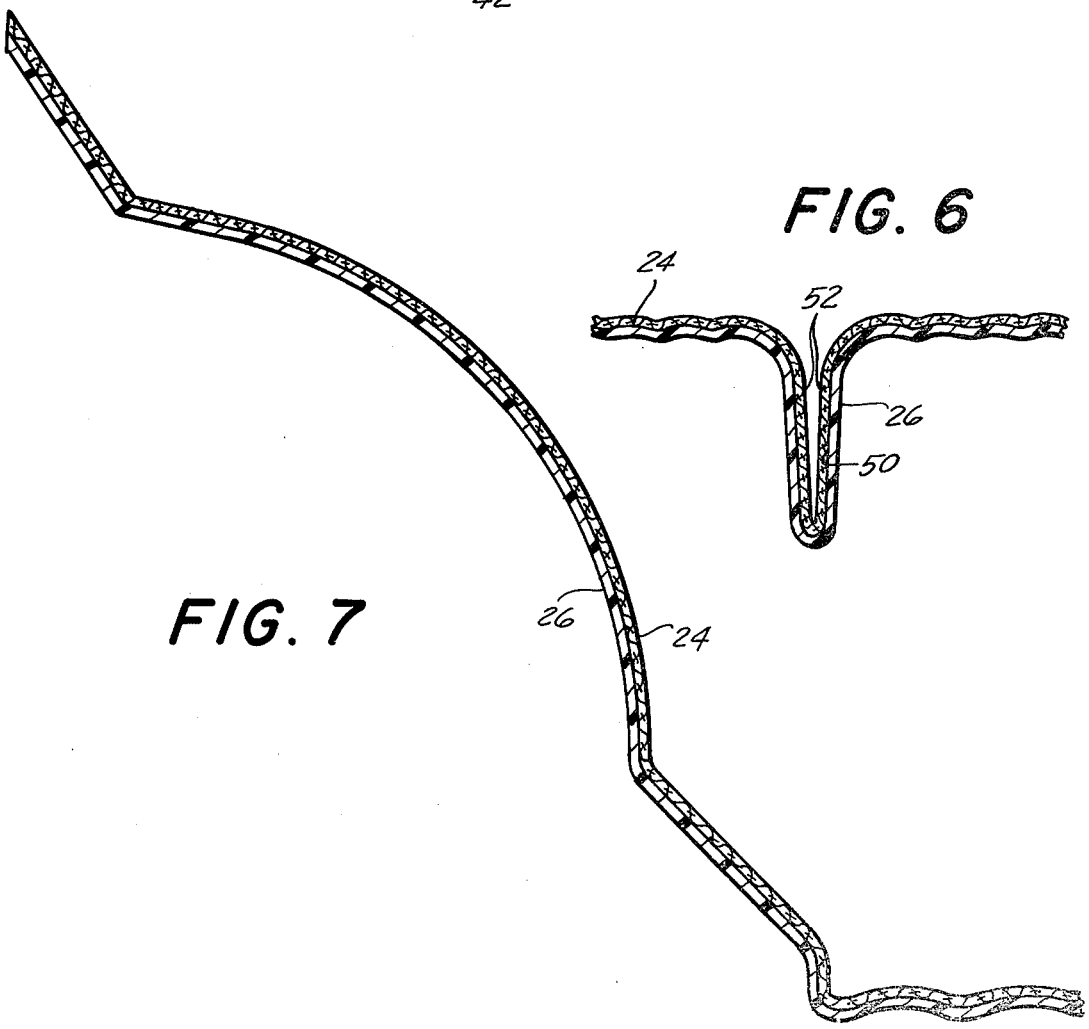

HEADLINERS FOR CASKETS

BACKGROUND OF THE INVENTION

Casket interiors have been traditionally made from corrugated board structures which are pre-cut, mitered and stapled or otherwise joined together into a generally rectangular shape to form a framework over which selected casket industry upholstery is secured. Examples of such prior art interiors are disclosed in U.S. Pat. Nos. 2,664,615 and 3,077,016. In addition the selected material would initially be slit and then subjected to a sheering operation and then applied in the form of puffing. Thus it will be quite evident that a relatively large number of steps are required before such prior art interiors are snapped into the lid of a casket. Needless to say a considerable savings in time, labor and material would result with the elimination of one or more of these steps and a reduction in the amount of handwork and skill required by the prior art interior fabrication techniques would ensue.

SUMMARY OF THE INVENTION

A principal object of the present invention is to provide for casket interiors that simulate traditional sheering in puffing in the formation of a headliner by utilizing a vacuum forming technique which simultaneously molds a thermo-plastic liner member into the selected configuration and adheres selected fabric material thereto. A further object is to provide a headliner of the foregoing type in which provisions are made for taking up and receiving excess fabric material that results from the thermo-forming operation and conceals this excess material and at the same time eliminates wrinkles and undesirable pleats. Another object is to eliminate the drawbacks and disadvantages of the prior art headliner interior fabrication techniques by reducing to an absolute minimum required hand labor skill and manipulating steps.

Other objects or advantages will come apparent from the following detailed description which is to be taken in conjunction with the accompanying drawings.

BRIEF DESCRIPTION OF THE DRAWINGS

In the drawings:

FIG. 5 is a front elevation view of the finished headliner with the fabric on the contour of the molded thermoplastic liner for purposes of simulating a traditional sheered puffing along the liner side;

FIG. 6 is an enlarged cross-sectional view taken along the lines 6—6 of FIG. 5; and FIG. 7 is a similar enlarged cross-sectional view taken along the line 7—7 of FIG. 5

DETAILED DESCRIPTION

Figure 1:
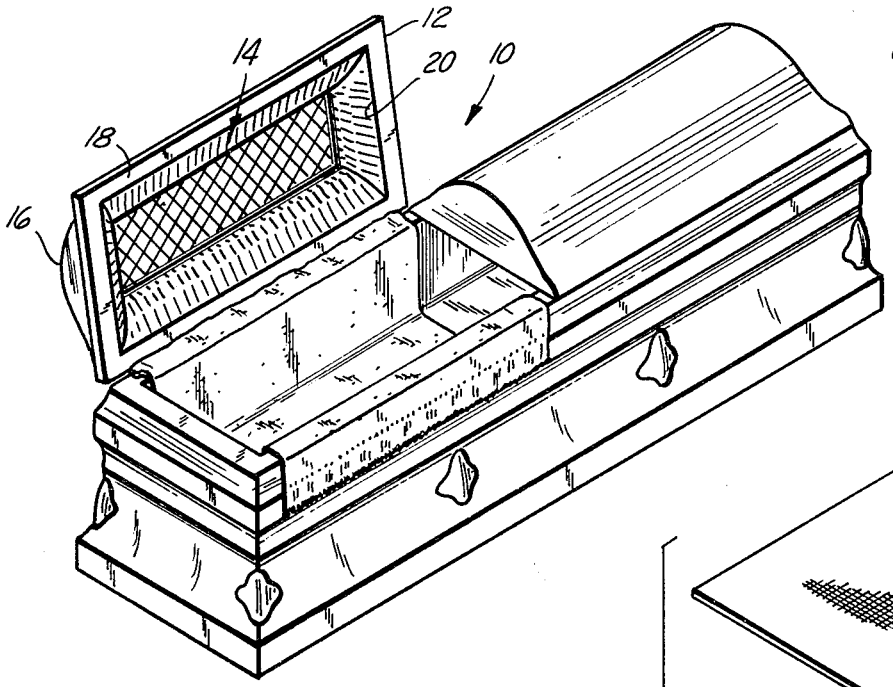
FIG. 1 is a perspective view of a perfection half couched casket incorporating the interior cap liner of this invention.

Referring now to the drawings in detail, FIG. 1 illustrates a typical burial casket of the "perfection half-couched" type generally denoted by reference numeral 10 having a head lid 12 where the head lid is shown in an open position exposing the head liner generally referred to by the reference numeral 14 providing the desired and selected interior or upholstery for the casket. The head liner 14 in accordance with the present invention is bodily inserted or popped into and retained within the head lid 12. While the headliner 14 is shown as an imitation of the pattern of traditional sheered material or puffing, it should be understood that other designs patterns and effects are envisioned.

The head lid 12 of the casket includes outer concave shell 16 formed with an inturned and inwardly directed peripheral flange 18 defining a liner receiving opening 20.

Figure 2:
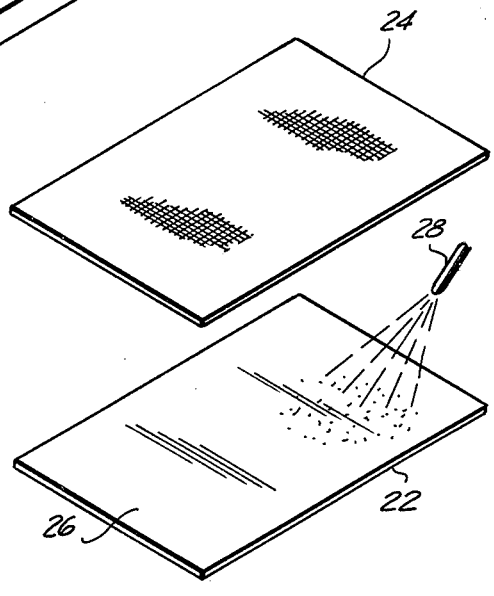
FIG. 2 is an exploded perspective view of the relatively flat sheet of thermoplastic material and selected fabric that are adhered to one another and vacuumed formed into the selected configuration, and interior pattern.
Figure 3:
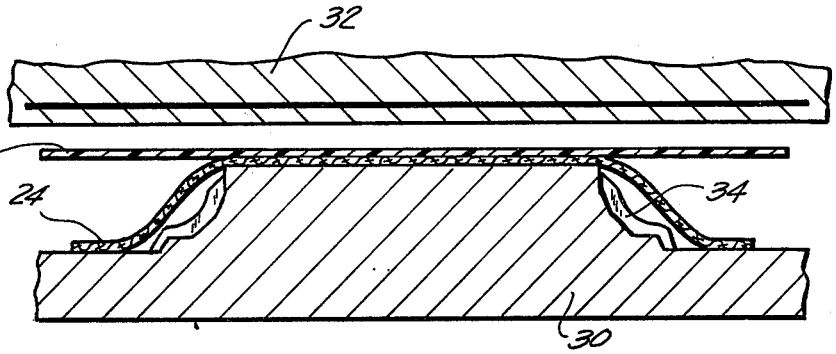
FIG. 3 is an enlarged fragmentary and sectional view showing the manner by which the layers are vacuumed formed into the selected configuration.
Figure 4:
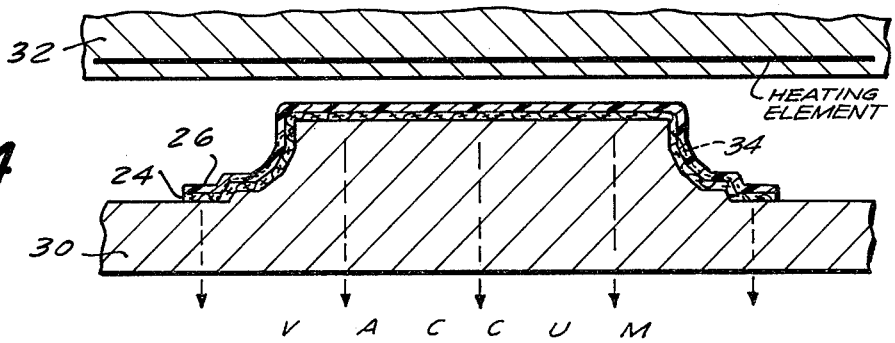
FIG. 4 is a similar view showing the layers assuming the selected contour and configuration during the vacuum forming process.

As shown in FIG. 2 the headliner 14 is initially formed from a relatively flat and substantially rectangular sheet 22 of thermoplastic material having substantially uniform thickness and a layer 24 of the selected fabric for the casket interior. The face 26 that eventually receives the fabric 24 will have an adhesive material 28 applied thereto first prior to the vacuum-forming or molding operation.

Any conventional and commercially available vacuum forming machine may be employed and typical of such machines is a bottom or base plate which supports the mold 30 for the head liner. Above the mold 30 is a downwardly reciprocal heat applying plate 32 whose function is to place the thermoplastic sheet 26 in a sufficiently softened or pliable condition at which it will assume the configuration of the mold 30 incident to the application of a suitable amount of suction or negative pressure thereto.

At the start of the vacuum forming operation the layer 24 of fabric is placed over the mold 30 and then the thermoplastic sheet 26 with the adhesive coating 28 facing downwardly is placed over the fabric. When the plastic sheet 26 has been sufficiently softened and made pliable by the heater 32, suction is drawn across the mold 30 to draw the fabric layer 24 and plastic sheet 26 into firm engagement with the contours of the mold 30. Thereafter the formed plastic sheet 26 is sufficiently cooled in order to set the composite structure into the configuration of the mold 30. In this regard ridges 34 are provided on the mold 30 of sufficient height to permit excess portions of the fabric to be taken up and extend into the recess thus formed in the thermoplastic layer 26. In this manner undesirable wrinkles and pleats are avoided and eliminated and the fabric layer 24 will conform to the contour formed in the thermoplastic 26 to provide the selected appearance of casket interior for the headliner. The thusly formed headliner will now be ready for insertion into the head lid.

In the illustrated embodiment of headliner 14 a central substantially flat and generally rectangular center panel 38 is provided with any one of a number of patterns that may be adopted. Extending transversely from a central panel 38 is an apron 40 defined by four transversely extending slides 42, 44, 46 and 48 which cooperate in defining the corners 36. The recess at each corner formed in the thermoplastic layer 26 is shown more clearly in FIGS. 6 and 7 and denoted by the numeral 50. The excess portions of the material taken up by the recesses 50 are denoted by the numeral 52. Where desired or necessary a staple or other form of fastening means may extend through the plastic material across the recess 50 to provide for a tight joint and also to facilitate insertion of the headliner into the head lid.

As stated in the foregoing, anyone of many fabric patterns or upholstery effects may be simulated by the present invention. In the illustrated embodiment a traditional sheered material or puffing effect is attained. A suitable plastic for layer 26 is a high impact styrene. The fabric layer 24 may be formed from typical industry cloth, flat crepe, tafetta or other natural or synthetic materials. A suitable adhesive that has been deployed Insulation Cap Adhesive number 34 manufactured by the 3-M Company. In successful applications of the present invention the resin of layer 26 as well as the adhesive penetrated pores and interstices of the fabric layer 24.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An improved liner adapted to be received and self-supported on an inwardly directed peripheral flange defining a liner receiving opening of a casket lid, the liner defining a casket interior and comprising a molded, unitary, self-supporting liner member molded from a single sheet of the thermoplastic material, the liner member having a central panel and a transversely extending apron, the apron defining at least one corner extending outwardly of and away from the panel having a recess at the corner extending outwardly of and away from the panel, the central panel and apron having an inner face and the recess opening therein, a layer of fabric adhering to the inner face of the panel and apron and conforming to the contour thereof, while excess portions of the fabric extend into the recess to provide the selected appearance of casket interior for the head lid.

2. The invention in accordance with claim 1, wherein the central panel being substantially flat and rectangular in shape and the transverse apron having four sides defining four of said corners, each of which includes a recess receiving excess portions of the fabric.

3. The invention in accordance with claim 2, wherein each of the sides being substantially convexly curved.

4. The invention in accordance with claim 1, wherein the thermoplastic sheet material is of substantially uniform thickness.

5. The invention in accordance with claim 1, wherein the apron is formed with a predetermined pattern such that when the fabric conforms to the contour thereof, a traditional sheered effect on puffing is simulated.

6. The invention in accordance with claim 1, wherein the liner member has a peripheral dimension larger than the lid opening and the liner rests within the lid on the inwardly directed flange.

7. The invention in accordance with claim 1, wherein adhesive is applied to a face of the sheet of thermoplastic material immediately prior to molding and the layer of fabric is disposed over this adhesively coated face and thereafter the liner member is vacuum molded and the layer of fabric conforms to the contour of the liner member during the vacuum molding operation and is adhered thereto by the adhesive.

8. An improved liner adapted to be received by a casket lid having at least one corner, the liner defining a casket interior and comprising a substantially contoured molded, unitary liner member molded from a single sheet of thermoplastic material into a selected configuration having a peripheral edge and at least one recess at the corner extending towards the peripheral edge in a contoured face thereof, and a layer of fabric adhered to said face of the liner member with excess portions of the liner extending into the recess.

* * * * *